US011830645B2

(12) United States Patent
Simon et al.

(10) Patent No.: US 11,830,645 B2
(45) Date of Patent: Nov. 28, 2023

(54) PERMANENT MAGNET WITH INTER-GRAIN HEAVY-RARE-EARTH ELEMENT, AND METHOD OF PRODUCING SAME

(71) Applicant: ABB Schweiz AG, Baden (CH)

(72) Inventors: Reinhard A. Simon, Baden-Daettwil (CH); Jacim Jacimovic, Wettingen (CH); Lorenz Herrmann, Windisch (CH); Tomaz Tomse, Ljubljana (SI)

(73) Assignee: ABB Schweiz AG, Baden (CH)

( * ) Notice: Subject to any disclaimer, the term of this patent is extended or adjusted under 35 U.S.C. 154(b) by 872 days.

(21) Appl. No.: 16/732,426

(22) Filed: Jan. 2, 2020

(65) Prior Publication Data

US 2020/0143963 A1 May 7, 2020

Related U.S. Application Data

(63) Continuation of application No. PCT/EP2017/066794, filed on Jul. 5, 2017.

(51) Int. Cl.
*H01F 1/00* (2006.01)
*B22F 3/10* (2006.01)
(Continued)

(52) U.S. Cl.
CPC ..... *H01F 1/0536* (2013.01); *B22F 3/10* (2013.01); *H01F 1/0577* (2013.01); *H01F 7/02* (2013.01); *H01F 41/0293* (2013.01)

(58) Field of Classification Search
CPC ..... H01F 1/0536; H01F 1/0577; H01F 7/02; H01F 41/0293; H01F 41/0266; B22F 3/10
See application file for complete search history.

(56) References Cited

U.S. PATENT DOCUMENTS 8,002,906 B2 8/2011 Suzuki et al.
8,961,712 B2 2/2015 Hayakawa et al.
(Continued)

FOREIGN PATENT DOCUMENTS

CN 1358595 A 7/2002
CN 101640087 A 2/2010
(Continued)

OTHER PUBLICATIONS

China Second Office Action issued by the Chinese National Intellectual Property Administration; dated Aug. 2, 2021, regarding correspondence patent application Serial No. 201780094631.6; 8 pages with translation.
(Continued)

*Primary Examiner* — Anthony M Liang
*Assistant Examiner* — Danny N Kang
(74) *Attorney, Agent, or Firm* — Greenberg Traurig, LLP

(57) ABSTRACT

A manufacturing method of a sintered magnet is described. The method includes forming a pre-sintering body from a first magnetic powder and a second magnetic powder (containing a heavy rare earth element, HRE) so that at least part of the second magnetic powder is provided at at least one inner portion of the pre-sintering body and surrounded format least two opposite sides by the first magnetic powder; sintering the pre-sintering body; and annealing the sintered pre-sintering body at an annealing temperature lower than the sintering temperature, thereby causing inter-grain diffusion of HRE from the HRE reservoir zone to the grain boundary phase. After the annealing, the grain boundary phase contains the HRE in a higher concentration than the main phase.

24 Claims, 2 Drawing Sheets

(51) Int. Cl.

| | |
|---|---|
| ***H01F 7/02*** | (2006.01) |
| ***H01F 41/00*** | (2006.01) |
| ***H01F 1/053*** | (2006.01) |
| ***H01F 1/057*** | (2006.01) |
| ***H01F 41/02*** | (2006.01) |

(56) References Cited

U.S. PATENT DOCUMENTS

| | | | | |
|---|---|---|---|---|
| 9,786,419 | B2 | 10/2017 | Liang et al. | |
| 2005/0133117 | A1 | 6/2005 | Tayu et al. | |
| 2007/0240789 | A1 | 10/2007 | Nakamura et al. | |
| 2013/0299050 | A1 | 11/2013 | Kuniyoshi | |
| 2014/0271323 | A1 | 9/2014 | Wang | |
| 2015/0099104 | A1 | 4/2015 | Liang et al. | |
| 2015/0248954 | A1 | 9/2015 | Sun | |
| 2016/0104573 | A1* | 4/2016 | Lee | C22C 1/05 419/38 |

FOREIGN PATENT DOCUMENTS

| | | | |
|---|---|---|---|
| CN | 104043834 | A | 9/2014 |
| CN | 104575895 | A | 4/2015 |
| DE | 112012004991 | T5 | 8/2014 |

OTHER PUBLICATIONS

Chinese Patent Office, First Office Action issued in corresponding Application No. 201780094631.6, dated Feb. 26, 2021, 16 pp.

European Patent Office, International Search Report & Written Opinion issued in corresponding Application No. PCT/EP2017/066794, dated Apr. 9, 2018, 14 pp.

* cited by examiner

PERMANENT MAGNET WITH INTER-GRAIN HEAVY-RARE-EARTH ELEMENT, AND METHOD OF PRODUCING SAME

Aspects of the invention relate to a sintered permanent magnet comprising a main phase of grains having an R-T-B (e.g., Nd—Fe—B) structure, and an heavy rare earth element (EIRE) containing grain boundary phase in-between the grains. Aspects of the invention also relate to a manufacturing method of such a sintered magnet, the method comprising forming a pre-sintering body, sintering and annealing the body.

TECHNICAL BACKGROUND

Sintered R-T-B based magnets, such as Nd—Fe—B magnets, are known as highly performant permanent magnets and have been used in various types of applications including for electrical machines such as motors or generators. One of the disadvantages of these magnets is that they lose their coercivity at high temperatures, causing irreversible flux loss.

In order to alleviate this problem, it has been known to increase the coercivity by partly replacing the R (e.g., Nd) of the R-T-B phase by a heavy rare-earth element (HRE) such as Dy or Tb. With this measure, although the coercivity increases, the remanence decreases. Furthermore, the HRE, being a rare and expensive material, should be used sparingly.

In US 2007/240789 A1, for Nd—Fe—B magnets it has been proposed that the above problems can be partly overcome by arranging a HRE diffusion source at the outside of a sintered magnet and then performing a grain boundary diffusion (GBD) process, in which the HRE diffuses from the outer surface of the magnet body to the inside, along the intergrain phase of the sintered magnet. As the majority of the HRE, remains in the intergrain phase, only a very small amount of HRE is needed for achieving a very high magnet performance. In addition, by limiting the HRE's presence mostly to the grain boundary, the coercivity increases, without excessive decrease in the remanence and without excessive consumption of HRE.

Further, in US 2013/0299050 A1, a method for producing a sintered R-T-B based magnet comprising the following steps has been proposed: providing a sintered R-T-B based magnet material; providing HRE diffusion sources and arranging them in contact with the sintered R-T-B based magnet material; performing a HRE diffusion process by carrying out a heat treatment; and then performing a process to separate the plurality of HRE diffusion sources from the sintered R-T-B based magnet material. Further processes are discussed in the references cited in this document.

However, for the known GBD processes, the diffusion path realized is in the range of about 1 mm to at most 2 mm. The GBD process therefore only allows the production of small magnets of maximum thicknesses well below 5 mm.

Thus, there is a need for a magnet having at least some of the above-mentioned advantages associated with the GBD process (high magnetic performance, increased coercivity, acceptable remanence, modest HRE consumption), without being overly restricted in terms of size or geometry of the magnet.

SUMMARY OF THE INVENTION

In view of the above, a sintered permanent magnet according to claim 1 and a manufacturing method of a sintered magnet according to claim 13 as well as a use thereof according to claim 15 are provided.

The inventors realized that it is possible to create a FIRE reservoir zone in the bulk of the sintered magnet by embedding a HRE-containing magnetic powder in the pre-sintering body prior to sintering. The HRE reservoir zone may be sintered together with the pre-sintering body and is kept essentially intact during the sintering. With this HRE reservoir zone, it is then possible to perform an annealing step with inter-grain diffusion of the HRE from the HRE reservoir zone to the grain boundary phase. This approach was made possible by the realization that the HRE reservoir zone can remain essentially intact during the sintering step and that the HRE can therefore be added prior to sintering, and not only after sintering as in the known GBD process. Thus, the HRE reservoir zone is not limited to the surface but may be embedded into the bulk of the magnet as well. Thereby, it is made possible to produce magnets of many different sizes and shapes, in particular magnets having a larger thickness than those for which the known GBD process was available, while keeping advantages associated with the GBD process.

Further advantages, features, aspects and details that can be combined with embodiments described herein are evident from the dependent claims, the description and the drawings.

BRIEF DESCRIPTION OF THE FIGURES

The details will be described in the following with reference to the figures, wherein.

DETAILED DESCRIPTION OF THE FIGURES AND OF EMBODIMENTS

Reference will now be made in detail to the various aspects and embodiments, examples of which are illustrated in the figures. Each example is provided by way of explanation and is not meant as a limitation. Further, any aspect described herein can be combined with any other aspect(s) or embodiments described herein unless specified otherwise.

Figure 1:
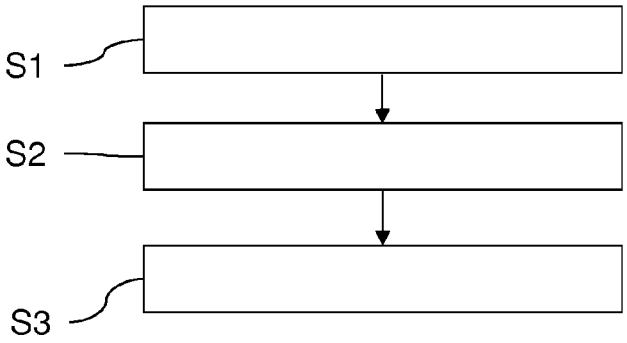
FIG. 1 is a schematic flow chart illustrating a manufacturing method of a sintered magnet according to an embodiment.

With reference to FIG. 1, a manufacturing method of a sintered magnet according to an embodiment of the invention is described. In addition, the method may include any further details as described elsewhere in this disclosure, such as possible compositions of the first and second magnetic powder and detailed sintering or annealing conditions.

First, in step S1, a pre-sintering body is formed. The pre-sintering body is formed from two different magnetic powders, herein referred to as first and second magnetic powders.

The first magnetic powder has an R-T-B structure as described herein, such as an $Nd_2Fe_{14}B$ powder. However, any other R-T-B powder described, for example, in US 2013/0299050 A1 may be used as well as the first magnetic powder. The second magnetic powder contains a heavy rare earth element (HRE) and has a lower melting temperature $T_{M2}$ than the melting temperature $T_{M1}$ of the first magnetic powder.

In the sintered magnet (i.e. after step S2 described below), the second magnetic powder will create an (internal) HRE reservoir for a subsequent grain boundary diffusion process (step S3 described below). To this purpose, the powders are arranged in respective zones (i.e. first magnetic powder zone and second magnetic powder zone, where it is understood that the term zone may refer to a plurality of non-connected zones) of the pre-sintering body so that at least part of a second magnetic powder zone, i.e. the future HRE reservoir, is provided at an inner portion of the pre-sintering body and surrounded from at least two opposite sides by a first magnetic powder zone.

The powders are then compacted on a compression molding machine while being oriented under a magnetic field. In other respects, the pre-sintering body can be formed according to any known method of green body forming. The pre-sintering body is dimensioned to have a thickness of at least 6 mm. Herein, a pre-sintering body may be in particular a green body, e.g., obtained by mechanical pressing. But, a pre-sintering body is to be understood broadly and does in particular not need to be pressed. Thus, any arrangement of powder zones is to be understood as pre-sintering body forming. In particular, also an arrangement of the first and second powders for Spark Plasma Sintering is understood as forming of a pre-sintering body.

Next, in step S2, the pre-sintering body is sintered at a sintering temperature $T_s$ that is higher than the melting temperature $T_{M2}$ of the second magnetic powder and lower than the melting temperature $T_{M1}$ of the first magnetic powder, thereby creating a pre-annealing sintered magnet. The pre-annealing sintered magnet has a main zone corresponding to the first magnetic powder zone of the pre-sintering body and mainly created from the first magnetic powder, and an HRE reservoir zone corresponding to the second magnetic powder zone of the pre-sintering body and mainly created from the second magnetic powder.

The main zone is characterized by a main phase of grains with a grain boundary phase in-between the grains. Part of the second magnetic powder material may, in addition, diffuse into the main zone and vice versa; however this diffusion should be minimal. The sintering time is selected sufficiently short so that the main zone and the HRE reservoir zone remain as discernable zones.

Figure 2:
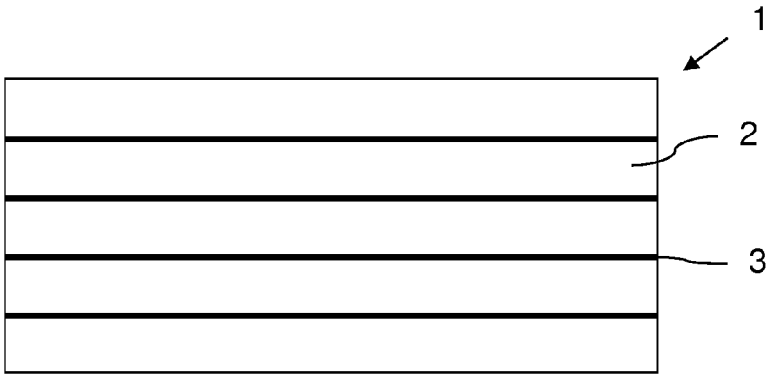
FIG. 2 is a schematic view of a pre-annealing sintered magnet according to an embodiment.
Figure 3:
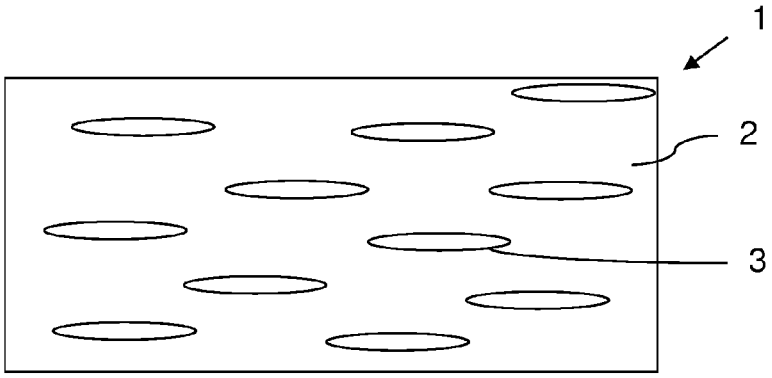
FIG. 3 is a schematic view of a pre-annealing sintered magnet according to a further embodiment.

FIGS. 2 and 3 show two possible arrangements of the main zone 2 and the HRE reservoir zone 3 in the pre-annealing sintered magnet 1 according to two possible embodiments. Likewise, these Figures can be seen as illustrating a possible arrangement of the first and second magnetic powder zones 2, 3 in the pre-sintering body 1.

In the embodiments of FIGS. 2 and 3, the main zone 2 constitutes the bulk of the pre-annealing sintered magnet 1. In FIG. 2, the HRE reservoir zones 3 are embedded in the main zone 2 as evenly spaced, substantially parallel thin layers extending, in a cross-sectional area, from one end to the other end of the magnet 1. In FIG. 3, the HRE reservoir zones 3 are more compact (each dimension being substantially less than the dimension of the main zone) and dispersed in the main zone 2 in a three-dimensional dispersion pattern so that the main zone 2 percolates through the entire magnet 1. Optionally, the HRE reservoir zones 3 may (also) percolate the magnet 1 (not shown).

In FIGS. 2 and 3, a sharp boundary is drawn between the main zone 2 and the HRE reservoir zone 3. The sintering process may lead to a limited diffusion of part of the HRE reservoir zone 3 into the main zone 2, somewhat blurring this limit. However, the sintering time is selected such that at least a portion of the HRE reservoir zone 3 remains discernible also after sintering.

The sintering method of step S2 may be carried out by any sintering method that ensures that the HRE is not spread out across the whole volume and does not diffuse into the grains fully, so that the HRE reservoir zone remains at least partially intact. Preferably, the method is carried out by spark plasma sintering (SPS), particularly preferably with a fast sintering time of less than 10 min, e.g., less than 5 min or between 5 min and 10 min. The sintering temperature may be set to 600-1200° C., preferably to at least 750° C. and/or at most 1100° C. In addition to the sintering time, there may be a heat-ramping period, in which the heat ramping rate is preferably more than 100° C./min. Other sintering conditions can be set according to usual settings for sintering.

The invention is not limited to SPS sintering, and any other sintering method, in which HRE diffusion is limited and the HRE reservoir zone remains at least partially intact, is also encompassed in the present invention.

Next, in step S3, the sintered magnet is annealed by heating it to an annealing temperature $T_A$ and holding it at that temperature (or within a temperature range around $T_A$, within the range specified herein) for an annealing time $t_a$. The annealing temperature $T_A$ is lower than the sintering temperature of step S2 and preferably not lower than the melting temperature $T_{M2}$ of the second magnetic powder, at least by a tolerance of 10° C., thereby causing inter-grain diffusion of HRE from the HRE reservoir zone to the grain boundary phase of the main zone 2. The annealing time $t_a$ is sufficiently long to allow the HRE to diffuse and distribute along the grain boundary.

As a result, after the annealing, the grain boundary phase of the finished sintered magnet contains at least one heavy rare earth element (HRE) in a higher concentration than the main phase of the main zone 2.

The sintered magnet according to this process has the advantage that the HRE is contained in the grain boundary phase in a higher concentration than in the main phase. Adding HRE just at the grain boundaries improves the magnet properties drastically. In particular, it is known from previously reported grain boundary diffusion processes that the resulting magnet can have high magnetic performance, increased coercivity while keeping acceptable remanence, with only limited HRE consumption since the HRE only needs to accumulate in the inter-grain phase. Even if only some of these advantages are achieved partially, the result is a highly attractive magnet.

Similar advantages had so far only been achieved for surface GBD process in which the HRE reservoir was applied to the magnet's surface after sintering. Thereby, it was possible to achieve HRE diffusion on lengths of about 2 mm or less, so that magnets of a thickness of about 2 to 3 mm, i.e., considerably less than 6 mm thickness, could be obtained. By providing an internal HRE reservoir according to aspects of the present invention, this limitation is overcome. According to a preferred aspect, the HRE reservoir is kept essentially intact during sintering, e.g., during Spark Plasma Sintering.

In an example method of the present invention, for step S1, the pre-sintering body has been formed from an $Nd_2Fe_{14}B$ powder as the first magnetic powder and from a eutectic DyNi alloy powder as the second magnetic powder, has been sintered by SPS sintering and has been annealed.

Figure 4:
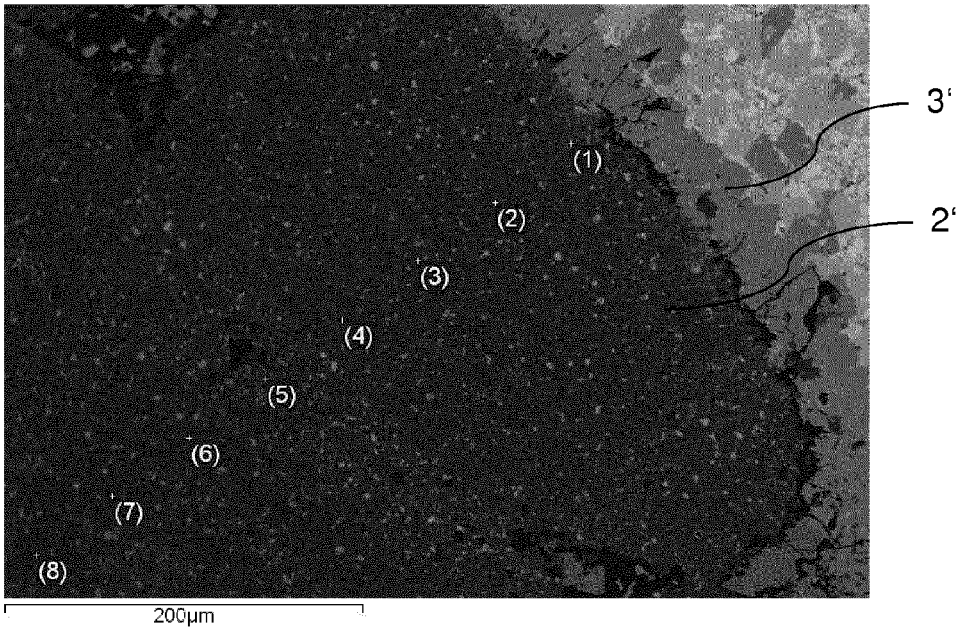
FIG. 4 is a microscopic image of a sintered magnet according to an embodiment of the invention.

FIG. 4 shows a microscopic image of the resulting magnet of such a sintering process. The magnet has a main zone 2'

(obtained from the main zone 2 as illustrated in FIGS. 2 and 3 after annealing), and a HRE rich remnant zone 3' (obtained from the HRE reservoir zone 3 as illustrated in FIGS. 2 and 3 after annealing). In this embodiment the HRE reservoir zone 3 has been diminished by the diffusion of FIRE into the grain boundaries of the main zone 2 and has not completely disappeared, but left behind the remnant zone 3'.

For the magnet obtained by the above-described example method, the elemental Dy concentrations in the main zone 2' has been checked at different distances from the former HRE reservoir zone (i.e. from the boundary between the main zone 2' and the HRE rich remnant zone 3'), as illustrated by the positions (1) to (8) in FIG. 4. The resulting Dy concentrations were obtained as follows:

TABLE 1

| Position | Dy concentration [mass %] |
|---|---|
| (1) | 7.8 |
| (2) | 6.2 |
| (3) | 6.8 |
| (4) | 6.2 |
| (5) | 5.9 |
| (6) | 5.4 |
| (7) | 1.4 |
| (8) | 4.2 |

This example shows that for the sintering conditions defined above, the HRE reservoir has led to HRE diffusion into the main zone. The diffusion length can be adapted by changing the density of the pre-sintering body and/or annealing conditions such as annealing time $t_a$ and temperature $T_A$.

The microscopic image of FIG. 4 illustrates the general diffusion into the main zone 2', but does not directly allow to distinguish between gain-boundary diffusion and diffusion into the bulk of the main zone. This distinction would be directly obtainable with a higher-resolution microscopic technique such as TEM microscopy. Here, in the following, we rather describe an indirect indication of grain-boundary diffusion of the HRE.

Figure 5:
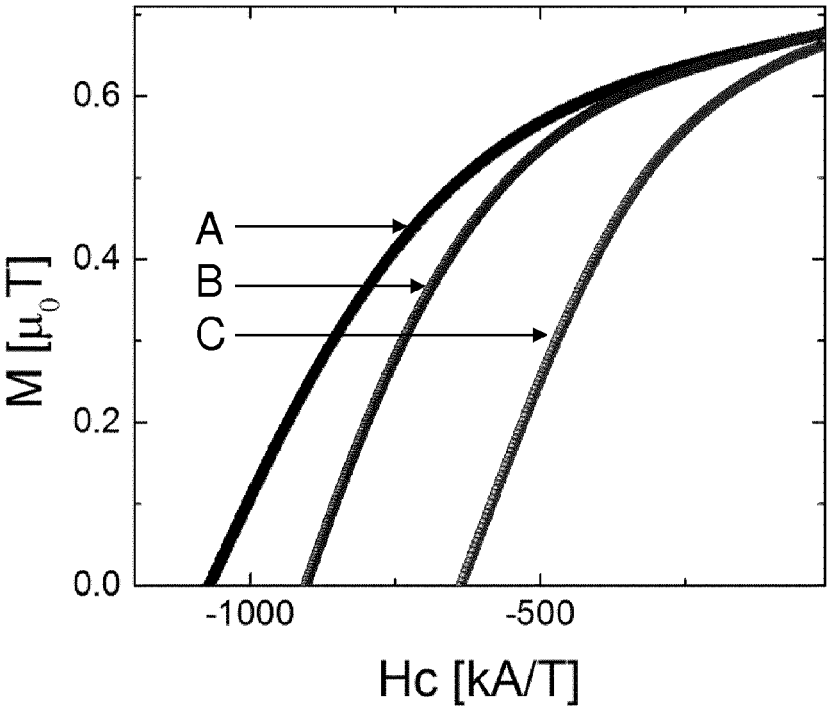
FIG. 5 is an M-H plot of sintered magnets according to an embodiment of the invention and according to comparative examples.

FIG. 5 is an M-H plot of the sintered magnets. The plot A was obtained from the magnet according to the above-described embodiment of the invention. Plot B was obtained for a magnet in which, relative to the magnet of plot A, the annealing step was omitted. Plot C was obtained for a magnet in which, relative to the magnet of plot A, no second magnetic powder was added (i.e. no HRE is contained in the magnet) and the annealing step was omitted.

A comparison of curve A to curve B in FIG. 5 reveals that the additional annealing treatment of the sample of curve A leads to a pronounced increase in coercivity, while the remanence (remanent polarization) of the sample is not significantly affected. This is an indication that the annealing treatment indeed caused a significant amount of the HRE to diffuse into the grain boundary phase, and not into the bulk of the main zone.

Next, some preferred (i.e., optional) additional aspects and details regarding the materials, process steps and parameters and the resulting sintered magnet are described in more detail. These aspects illustrate preferred modes of the invention, without the invention being limited to these aspects. It is understood that each aspect can be combined with any other aspect or embodiment described herein, unless stated otherwise. The present invention encompasses any such combinations.

First, aspects relating to the first magnetic powder and to the main phase of the grains of the resulting sintered magnet are described. While the aspects in the following refer to the first magnetic powder, these aspects may also describe the main phase of the sintered magnet, unless they refer to properties that are clearly lost during the sintering and annealing steps.

According to an aspect, the first magnetic powder has an $R_2T_{14}B$ type structure. Herein, the term "type structure" is understood to include a usual tolerance of the stoichiometric ratios, so that for example an R amount of 2.1 is encompassed within the meaning of an $R_2T_{14}B$ type structure. According to a further aspect, the $R_2T_{14}B$ structure is a $Nd_2Fe_{14}B$ structure. More generally, according to a further aspect, the first magnetic powder is a Nd—Fe—B-type powder.

According to a further aspect, the first magnetic powder comprises an alloy comprising at least one composition of elements a) to 1) selected from group I and, optionally, at least one element selected from group II. Herein, group I has the following elements: a) Al, Ni and Co; b) Sm and Co; c) Sm and Fe; d) Sm, Fe and N; e) Fe and N; f) Mn, Al and C; g) Mn and Bi; h) hard ferrite; i) Fe, B, and at least one rare earth element; j) Fe, C, and at least one rare earth element; k) Nd, Fe and B; l) Nd, Fe, B, and at least one rare earth element. Group II has the following elements: Al, Co, Cu, Ga, Nb, Ti, Zr, and at least one light rare earth element.

According to a further aspect, the first magnetic powder is uncoated and/or is free of any HRE-containing coating. According to an aspect, the first magnetic powder is free of HRE.

According to a further aspect, the first magnetic powder may be an eutectic or near-eutectic alloy (as defined below for the second magnetic powder).

The first magnetic powder may have several powder constituents. For example, according to an aspect, the first magnetic powder may be obtained by the two-alloy process described in US 2007/240789, with a primary phase alloy and a rare earth rich alloy serving as a liquid phase aid.

According to a further aspect, the melting temperature of the first magnetic powder is at most 1300° C., preferably at most 1200° C., more preferably at most 1150° C. According to a further aspect, the melting temperature of the first magnetic powder is at least 900° C., preferably at least 1000° C., more preferably at least 1050° C.

According to a further aspect, the first magnetic powder is provided as flakes having a thickness of at most 20 μm. The flakes may have a largest diameter of at least 50 μm and/or at most 300 μm. The flakes may have a ratio of largest diameter to thickness of at least 3, preferably at least 10.

According to a further aspect, the first magnetic powder is provided as a fine powder having a diameter of less than 20 μm. The diameter may be less than 10 μm. On the other hand, the diameter may be more than 0.5 μm or more than 1 μm. Herein, the diameter is defined as largest diameter. The aspect ratio (ratio of largest to smallest diameter) of the powder may be less than 3 and preferably less than 2. The first magnetic powder may, for example, be a Jet Milled powder.

Next, aspects relating to the second magnetic powder and to the intergrain phase are described.

According to an aspect, the HRE comprises at least one of Dy and Tb. For example, the HRE may be Dy.

According to a further aspect, the second magnetic powder may be a Dy—Ni—Al alloy powder or a Dy—Cu alloy powder. According to a further aspect, the intergrain phase may comprise Dy.

According to a further aspect, the second magnetic powder is a HRE containing metal or oxide powder such as a metal alloy powder. Examples with as the HRE include DyNiAl, NdDyCu, DyCu alloy, $Dy_2O_3$. Some or all of the Dy of these examples may be substituted by another HRE, in particular by Tb.

According to a further aspect, the second magnetic powder is an alloy having an eutectic or near-eutectic composition (near-eutectic being defined such that the melting temperature difference ($T_{M1}-T_{M2}$) is at least 50% of the melting difference for the corresponding eutectic alloy composition of the second magnetic powder; herein $T_{M1}$ and $T_{M2}$ are defined by the liquidus temperatures). Preferably the percentage is at least 70%. Particularly preferably, the melting temperature of the second magnetic powder at most 5%, in ° K, above the melting point of the corresponding eutectic alloy composition.

Examples of suitable eutectic alloys are a Dy—Ni—Al eutectic alloy ($Dy_{73}Ni_{9.5}Al_{17.5}$) and a Nd—Dy—Cu eutectic alloy ($Nd_6Dy_{20}Cu_{20}$).

According to a further aspect, the second magnetic powder contains FIRE in a concentration of at least 10 mass %, preferably at least 30 mass %. According to a further aspect, the magnet contains HRE in a total amount of 0.1 to 0.5 mass %, preferably 0.2 to 0.3 mass %.

If the first magnetic powder is a two-alloy process powder as mentioned above, the second magnetic powder may comprise the elements of the liquid phase aid with the rare earth element partially or fully substituted by the HRE element.

According to a further aspect, the second magnetic powder is provided as flakes having a thickness of at most 20 μm. The flakes may have a largest diameter of at least 50 μm and/or at most 300 μm. The flakes may have a ratio of largest diameter to thickness of at least 3, preferably at least 10.

According to a further aspect, the second magnetic powder is provided as a fine powder having a diameter of less than 20 μm. The diameter may be less than 10 μm. On the other hand, the diameter may be more than 0.5 μm or more than 1 μm. Herein, the diameter is defined as largest diameter. The aspect ratio (ratio of largest to smallest diameter) of the powder may be less than 3 and preferably less than 2. The second magnetic powder may, for example, be a Jet Milled powder.

Next, aspects relating to further features of the powders and their production are described.

The first and second magnetic powders may be obtained by any known method such as the methods described in US 2007/240789. According to an aspect, the first and/or second magnetic powder is produced by any one of a melt-spinning, Jet mill, HDDR (Hydrogen decrepitation deabsorbation recombination), and/or gas atomizing. It is preferred that the first and second magnetic powders arc anisotropic. For the second magnetic powders, the particularly preferred shape is a flake-like shape, because this shape is advantageous for producing thin layers of high aspect ratio. Therefore, especially for the second magnetic powder, melt-spun flakes are preferred.

According to a further aspect, the melting temperature of the first magnetic powder is higher than the melting temperature of the second magnetic powder, preferably by at least 20° C.

Next, aspects relating to the arrangement of the second magnetic powder in the pre-sintering body and of the HRE reservoir zones in the pre-annealing sintered magnet are described.

According to an aspect, the second magnetic powder (the HRE reservoir zones) is provided at a geometrically different zone from the first magnetic powder (from the main zone). In particular, at least part of the second magnetic powder (of the HRE reservoir zones) is provided at an interior portion of the pre-sintering body and partially or fully surrounded by the first magnetic powder (by the main zone).

According to an aspect, the first and second magnetic powders are provided in respective portions of the pre-sintering body that are spatially separated from each other. In other words, at least in some portions of the pre-sintering body the two powders substantially do not mix with each other. Likewise, according to an aspect, the main and HRE reservoir zones are provided in respective portions of the sintered magnet that are spatially separated from each other.

According to an aspect, the total volume of the HRE reservoir zone is smaller than the total volume of the main zone, preferably by at least factor 5 or even by factor 10 smaller.

According to a further aspect, the second magnetic powder is provided in a plurality of HRE reservoir zones of the pre-sintering body including a plurality of interior HRE reservoir zones being each surrounded from at least two opposite sides by the first magnetic powder. According to a further aspect, at least portions of the interior HRE reservoir zones are located at a depth of at least 3 mm from the nearest surface of the pre-sintering body.

According to a further aspect, the HRE reservoir zones of the sintered magnet include a plurality of interior HRE reservoir zones being each surrounded from at least two opposite sides by the main zones. According to a further aspect, at least portions of the interior HRE reservoir zones are located at a depth of at least 3 mm from the nearest surface of the sintered magnet.

According to a further aspect, a spacing between neighbouring HRE reservoir zones is at most 6 mm, preferably at most 4 mm, and/or by at least 1 mm. According to a further aspect, the HRE reservoir zones are spaced apart from each other in a thickness direction. According to a further aspect, the HRE reservoir zones arc HRE reservoir layers extending substantially perpendicular to a thickness direction.

According to a further aspect, an aspect ratio of the HRE reservoir zones is at least 5, preferably at least 10, the aspect ratio being defined as the ratio of the largest to smallest diameter of a HRE reservoir zone.

Next, aspects relating to the step of producing the pre-sintering body are described. Generally, the pre-sintering body can be produced by any known method of producing a pre-sintering body having different zones from different powders, and preferably by any known method of producing a pre-sintering body for SPS sintering. According to an aspect, the method includes (e.g., isostatic or uniaxial) pressing the pre-sintering body. To this purpose, the above-described step of arranging the powders is done in a suitable mold such as a rubber mold.

According to a further aspect, the method comprises magnetically aligning the pre-sintering body by applying an external magnetic field.

Next, aspects relating to the sintering step are described.

According to an aspect, the sintering is SPS sintering.

According to a further aspect, the sintering time is less than 600 s, preferably less than 400 s or even less than 300 s. According to a further aspect, the sintering temperature is higher than the melting temperature of the second magnetic powder. According to a further aspect, the sintering temperature is less than 1200° C. and more than 600° C.

According to a further aspect, the sintering conditions are adjusted for keeping a major portion, in mass %, of the at least one HRE reservoir intact. According to an aspect, the sintering conditions are selected for avoiding diffusion of, in mass %, more than 50%, preferably more than 20% of the HRE, into the main zone.

Next, aspects relating to the annealing step are described.

Generally, the annealing conditions are set for causing inter-grain diffusion of HRE from the HRE reservoir zone to the grain boundary phase. In particular the annealing temperature $T_A$ is set roughly equal (up to a tolerance of 10° C.) or higher than the melting temperature $T_{M2}$ of the second magnetic powder but lower than the melting temperature $T_{M1}$ of the first magnetic powder.

According to a further aspect, the annealing temperature is set lower than the sintering temperature, preferably by at least 10° C., more preferably by at least 30° C. According to a further aspect, the annealing temperature is set lower than the sintering temperature minus 100° C.

According to an aspect, the annealing temperature $T_A$ may for example be at most 1073° C., preferably at most 1000° C. According to a further aspect, the annealing temperature $T_A$ is more than 700° C., preferably more than 800° C.

According to a further aspect, the annealing time $t_a$ is longer than the sintering time, preferably by at least a factor of 2 or more preferably 5. The annealing time $t_a$ may, for example, be at least 1 h or even at least 2 h. The annealing time $t_a$ is sufficiently long to allow the HRE to diffuse and distribute along the grain boundary. According to a further aspect, the annealing time $t_a$ is at most 10 h.

According to an aspect, the annealing conditions, in particular the annealing time, is set for inter-grain diffusion of a major part of the HRE from the HRE reservoir zone to the grain boundary phase. In other words, the annealing results in diffusion into the inter-grain phase of, in mass %, more than 50%, preferably more than 70% of the HRE remaining in the HRE reservoir zone after sintering. According to an aspect, the annealing time may be set such that after annealing, the HRE from the HRE reservoir zone may have essentially diffused into the bulk, and the HRE reservoir zone may essentially disappear.

The annealing step S3 is preferably carried out in an inert gas atmosphere at a gas pressure of 0.1 bar or less or at vacuum.

Optionally, the annealing treatment may be followed by an aging treatment. The aging treatment is carried out at a temperature which is below the annealing temperature, preferably from 200° C. to a temperature lower than the melting temperature of the second magnetic powder. The atmosphere is preferably vacuum or an inert gas. The time of aging treatment can be from 1 minute to 10 hours.

Next, aspects relating to the sintered permanent magnet arc described.

According to an aspect, the sintered magnet comprises a main phase (i.e. constituting the bulk volume of the magnet) of grains having the R-T-B structure described herein, and the HRE-containing grain boundary phase in-between the grains described herein. In particular, the HRE-containing grain boundary phase contains at least one heavy rare earth element (HRE) in a higher concentration (in mass %) than the main phase. This condition is, according to an aspect, in particular fulfilled at a depth of at least 3 mm, preferably at least 6 mm or even at least 10 mm from the nearest surface of the magnet, i.e., in an interior region of the magnet more than these distances away from the nearest magnet surface.

According to an aspect, the magnet is a single sintered body, i.e. not assembled from a plurality of separately sintered bodies.

According to an aspect, the sintered magnet has a thickness (smallest diameter) of at least 6 mm, preferably at least 12 or even 20 mm.

According to a further aspect, an average density of the magnet is at least 4.0 g/cm$^3$ and/or at most 8.5 g/cm$^3$. According to a further aspect, the magnet is producible by the method described herein.

According to a further aspect, the magnet has substantially homogenous macroscopic properties (such as density, elemental composition, coercivity), not only when averaged over large distances but also when averaged over smaller distances. For example, the magnet has substantially homogenous macroscopic properties already when these properties are averaged on a scale of 2 mm and preferably on a scale of 500 μm. Herein, "substantially homogenous" means a deviation of less than 30%, preferably by less than 10% or even 5%.

Next, aspects relating to a possible use of the magnet are described.

According to an aspect, the magnet is used as a permanent magnet in an electrical machine. According to a further aspect, the electrical machine is at least one of an electric motor, a generator, a power transformer, an instrument transformer, a linear motion device a magnetically biased inductor, and a magnetic actuator. According to an aspect, the electrical machine is a synchronous machine.

The invention claimed is:

1. A manufacturing method of a sintered magnet, the method comprising:

forming a pre-sintering body from a first magnetic powder and a second magnetic powder so that at least part of the second magnetic powder is provided on at least one inner portion of the pre-sintering body and surrounded from at least two opposite sides by the first magnetic powder, wherein the first magnetic powder has an R-T-B structure, wherein R is at least one selected from the group consisting of Y, Ce, La, Pr, Nd, Sm, Eu and Gd, and T is one or more transition metal elements including Fe, wherein the second magnetic powder contains at least one heavy rare earth element (HRE), wherein a melting temperature $T_{M1}$ of the first magnetic powder is higher than a melting temperature $T_{M2}$ of the second magnetic powder, the pre-sintering body having a thickness of at least 6 mm;

sintering the pre-sintering body at a temperature $T_s$ being higher than the melting temperature $T_{M2}$ of the second magnetic powder and lower than the melting temperature $T_{M1}$ of the first magnetic powder, thereby creating a main phase of grains from the first magnetic powder with a grain boundary phase in-between the grains, and an HRE reservoir zone from the second magnetic powder, wherein the sintering is Spark Plasma Sintering; and annealing the sintered pre-sintering body at an annealing temperature $T_A$ lower than the sintering temperature $T_s$, thereby causing inter-grain diffusion of HRE from the HRE reservoir zone to the grain boundary phase so that after the annealing the grain boundary phase contains at least one heavy rare earth element (HRE) in a higher concentration than the main phase.

2. The method according to claim 1, wherein the R-T-B structure is a Nd—Fe—B structure.

3. The method according to claim 1, wherein the at least one heavy rare earth element (HRE) comprises Dy or Tb.

4. The method according to claim 1, wherein the second magnetic powder is a eutectic or near-eutectic alloy.

5. The method according to claim 1, wherein the melting temperature $T_{M1}$ of the first magnetic powder is higher than the melting temperature $T_{M2}$ of the second magnetic powder by at least 20° C.

6. The method according to claim 1, wherein the second magnetic powder is provided in a plurality of HRE reservoir zones of the pre-sintering body, the plurality of HRE reservoir zones being each surrounded from at least two opposite sides by the first magnetic powder.

7. The method according to claim 6, wherein the plurality of HRE reservoir zones are spaced apart from each other by at most 6 mm.

8. The method according to claim 6, wherein at least one of the plurality of HRE reservoir zones is located at a depth of at least 3 mm from a nearest surface of the pre-sintering body.

9. The method according to claim 1, wherein $T_{M2} \leq T_A + 10°$ C.

10. The method according to claim 1, wherein an annealing time and annealing temperature $T_A$ is set for inter-grain diffusion of a major part of the HRE from the HRE reservoir zone to the grain boundary phase.

11. The method according to claim 1, wherein the annealing temperature $T_A$ is set lower than the sintering temperature $T_s$, and/or higher than the melting temperature $T_{M2}$ of the second magnetic powder.

12. The method according to claim 2, wherein the at least one heavy rare earth element (HRE) comprises Dy or Tb.

13. The method according to claim 12, wherein the second magnetic powder is a eutectic or near-eutectic alloy.

14. The method according to claim 13, wherein the melting temperature $T_{M1}$ of the first magnetic powder is higher than the melting temperature $T_{M2}$ of the second magnetic powder by at least 20° C.

15. The method according to claim 2, wherein the second magnetic powder is a eutectic or near-eutectic alloy.

16. The method according to claim 2, wherein the second magnetic powder is provided in a plurality of HRE reservoir zones of the pre-sintering body, the plurality of HRE reservoir zones being each surrounded from at least two opposite sides by the first magnetic powder.

17. The method according to claim 16, wherein the plurality of HRE reservoir zones are spaced apart from each other by at most 6 mm.

18. The method according to claim 16, wherein at least one of the plurality of HRE reservoir zones is located at a depth of at least 3 mm from a nearest surface of the pre-sintering body.

19. The method according to claim 2, wherein the annealing temperature $T_A$ is set lower than the sintering temperature $T_s$, and/or higher than the melting temperature $T_{M2}$ of the second magnetic powder.

20. The method according to claim 2, wherein the HRE reservoir zone is located at a depth of at least 3 mm from a nearest surface of the pre-sintering body; and wherein $T_{M2} \leq T_A + 10°$ C.

21. The method according to claim 1, wherein the second magnetic powder is provided in a plurality of HRE reservoir zones of the pre-sintering body, wherein the HRE reservoir zones are spaced apart from each other by at most 3 mm.

22. The method according to claim 1, wherein $T_{M2} \leq T_A$.

23. The method according to claim 2, wherein $T_{M2} \leq T_A$.

24. The method according to claim 16, wherein the plurality of HRE reservoir zones are spaced apart from each other by at most 3 mm.

* * * * *